US011959489B2

(12) United States Patent
Cote

(10) Patent No.: US 11,959,489 B2
(45) Date of Patent: Apr. 16, 2024

(54) BANDED COOLING FAN BAND HAVING KNIT-LINE STRENGTH IMPROVEMENT

(71) Applicant: Robert Bosch GmbH, Stuttgart (DE)

(72) Inventor: Ray Cote, Dover, MA (US)

(73) Assignees: Robert Bosch LLC, Farmington Hills, MI (US); Robert Bosch GmbH, Stuttgart (DE)

( * ) Notice: Subject to any disclaimer, the term of this patent is extended or adjusted under 35 U.S.C. 154(b) by 30 days.

(21) Appl. No.: 17/915,752

(22) PCT Filed: Apr. 6, 2021

(86) PCT No.: PCT/EP2021/058880

§ 371 (c)(1),
(2) Date: Sep. 29, 2022

(87) PCT Pub. No.: WO2021/204767

PCT Pub. Date: Oct. 14, 2021

(65) Prior Publication Data

US 2023/0130411 A1 Apr. 27, 2023

Related U.S. Application Data

(60) Provisional application No. 63/147,511, filed on Feb. 9, 2021, provisional application No. 63/006,846, filed on Apr. 8, 2020.

(51) Int. Cl.

| | |
|---|---|
| ***F04D 29/32*** | (2006.01) |
| ***F04D 29/02*** | (2006.01) |
| ***F04D 29/38*** | (2006.01) |

(52) U.S. Cl.

CPC ..... *F04D 29/326* (2013.01); *F04D 29/023* (2013.01); *F04D 29/384* (2013.01)

(58) Field of Classification Search

CPC .... F04D 29/326; F04D 29/384; F04D 29/023; F04D 29/32; F04D 29/388; F05D 2230/20

See application file for complete search history.

(56) References Cited

U.S. PATENT DOCUMENTS

| | | | | |
|---|---|---|---|---|
| 6,508,624 | B2 * | 1/2003 | Nadeau | F01D 11/08 415/173.6 |
| 2002/0164247 | A1 * | 11/2002 | Nadeau | F04D 29/164 415/173.5 |
| 2021/0108595 | A1 * | 4/2021 | Khalid | F02K 1/76 |

FOREIGN PATENT DOCUMENTS

| | | |
|---|---|---|
| DE | 10 2010 039 219 A1 | 2/2012 |
| DE | 102010039219 | 2/2012 |

(Continued)

OTHER PUBLICATIONS

International Search Report corresponding to PCT Application No. PCT/EP2021/058880, dated Jun. 17, 2021 (English language document) (4 pages).

(Continued)

*Primary Examiner* — Igor Kershteyn
(74) *Attorney, Agent, or Firm* — Kelly McGlashen; Maginot, Moore & Beck LLP

(57) ABSTRACT

A fan includes a hub configured to be driven by motor to rotate about a fan rotational axis, blades that protrude radially from the hub and a band that surrounds the rotational axis and connects the tips of the blades. The band includes structurally-reinforcing thickened regions that protrude from outer surface of the band in a direction away from the hub. A thickened region is disposed between respective tips of each pair of adjacent blades. Each thickened portion bridges a knit-line of the band.

10 Claims, 5 Drawing Sheets

(56) References Cited

FOREIGN PATENT DOCUMENTS

| | | | |
|---|---|---|---|
| DE | 10 2013 015 835 | A1 | 4/2015 |
| DE | 102013015835 | | 4/2015 |
| DE | 10 2016 207 545 | A1 | 11/2017 |
| DE | 102016207545 | | 11/2017 |
| JP | 2003094494 | | 4/2003 |

OTHER PUBLICATIONS

PCT International Search Report for PCT/EP2021/058880.

* cited by examiner

BANDED COOLING FAN BAND HAVING KNIT-LINE STRENGTH IMPROVEMENT

This application is a 35 U.S.C. § 371 National Stage Application of PCT/EP2021/058880, filed on Apr. 6, 2021, which claims the benefit of priority to (i) Serial No. U.S. 63/006,846, filed on Apr. 8, 2020 in the United States, and (ii) Serial No. U.S. 63/147,511, filed on Feb. 9, 2021 in the United States, the disclosures of which are incorporated herein by reference in their entirety.

BACKGROUND

Automobiles typically require one or more air-moving fans to aid in heat-transfer through one or more heat-exchangers. For example, an axial flow fan may be used for automotive cooling that includes a hub coupled to a shaft of a motor, a plurality of blades that protrude from an outer circumference of the hub, and a band that connects tips of the blades so as to prevent the blades from being deformed.

Such fans are often manufactured in large volumes via a plastic injection molding process in which a mold of the fan 100 is injected with molten plastic in the vicinity of the hub-forming portion (FIG. 1). From the injection point(s) 101, the molten plastic (represented by arrows) flows within the mold cavity from the hub-forming portion, radially outward through the blade forming portions, and then circumferentially along the band-forming portion. When two flow-fronts meet within the band-forming portion, a knit-line 150 is formed in the resulting fan band 120. Knit-lines 150 are formed in the band 120 approximately mid-way between each pair of adjacent fan blades 140. Knit-lines 150 are typically weaker than other regions of the band 120 where there are no knit-lines 150, and thus may be a point of failure initialization within the fan 100.

The fan band knit line strength could be improved by simply increasing band thickness. But as thickness is added, the mass of the band increases and therefore the centrifugal stresses increase. Additionally, adding mass to an injection molded part far from the injection location is undesirable from a molding best-practices standpoint.

SUMMARY

In some aspects, a banded fan includes structurally reinforced knit-lines that improve the strength of band knit regions, thereby increasing overall the structural robustness of the fan.

To increase the stiffness and strength of the fan band between fan blades, where the band knit-line occurs, the band includes regions of increased radial thickness (referred to as "thickened regions") that are provided on the outward-facing surface of the fan band cylindrical portion. Each thickened region protrudes outward away from the hub and extends circumferentially across (or "bridges") the knit-line. Each thickened region is configured to have a smooth transition to other portions of the band outward-facing surface, and is dimensioned to lower stress in the band while ensuring that the knit-line is bridged and adequately reinforced.

By provided localized regions of increased thickness, the fan band knit line strength is improved while minimizing band mass increases, and thus also minimizing corresponding increases in the centrifugal stresses. In addition, the undesirable effects of added band thickness are minimized by limiting the band thickness addition to (1) the cylindrical portion of the band and (2) to regions of the band that are not radially aligned with the fan blades. This added thickness strategy adds strength to the weak band knit lines and does so efficiently by avoiding adding mass where it will not increase knit strength.

In some aspects, a fan includes a hub configured to be driven by motor to rotate about a fan rotational axis, and a band that surrounds the rotational axis and is concentric with the hub. The band includes a leading end that faces a direction of airflow through the fan, and a trailing end that is opposed to the leading edge. The fan includes blades that protrude radially from the hub. Each blade has a root that is connected to the hub and a tip that is connected to a hub-facing surface of the band. A distance between the fan rotational axis and the band is constant for every location along a line that extends about the circumferences of the band, where the line is disposed on the hub-facing surface of the band at the band trailing end. In addition, a radial dimension of the band is non-uniform along the line.

In some embodiments, the band includes a cylindrical portion, a lip portion and an intermediate portion. The cylindrical portion extends in parallel to the fan rotational axis and includes the band trailing end. The lip portion extends at an angle relative to the fan rotational axis. A surface of the lip portion includes the band leading end. The intermediate portion connects one end of the cylindrical portion to one end of the lip portion. The tip of each blade is joined to the cylindrical portion along a corresponding blade tip region. The cylindrical portion includes first regions of the line having a first radial dimension and second regions of the line having a second radial dimension. The second radial dimension is less than the first radial dimension. The first regions of the line are disposed between respective blade tip regions of tips of a pair of adjacent blades, and the second regions of the line are radially aligned with the respective blade tip regions.

In some embodiments, the first radial dimension is greater than an axial dimension of the lip portion.

In some embodiments, the first radial dimension is at least five percent greater than the second radial dimension.

In some embodiments, a dimension of the intermediate portion is non-uniform along a circumference of the band such that the dimension of the intermediate portion at locations radially aligned with the first regions of the line is greater than corresponding dimensions of the intermediate portion at locations radially aligned with the second regions of the line.

In some embodiments, the cylindrical portion includes third regions of the line having a tapered radial dimension. The third regions of the line provide a transition between the first regions of the line and the second regions of the line, wherein a circumferential dimension of each third region of the line is at least as long as a circumferential dimension of the first region of the line that it adjoins.

In some embodiments, the cylindrical portion includes third regions of the line having a tapered radial dimension. The third regions of the line provide a transition between the first regions of the line and the second regions of the line, wherein a sum of the circumferential dimensions of one of the first regions of the line and each adjoining third region of the line is at least fifty percent of a distance between tips of adjacent blades.

In some embodiments, the radial dimension of the band is non-uniform along the line such that the radial dimension varies periodically along the circumference of the band. In addition, the radial dimension is a maximum at locations between adjacent blades and is a minimum at locations aligned with a blade.

In some embodiments, the band includes a cylindrical portion, a lip portion and an intermediate portion. The cylindrical portion extends in parallel to the fan rotational axis, and includes the band leading end. The lip portion extends at an angle relative to the fan rotational axis. A surface of the lip portion includes the band trailing end. The intermediate portion connects one end of the cylindrical portion to one end of the lip portion. The tip of each blade is joined to the cylindrical portion along a corresponding blade tip region. The cylindrical portion includes first regions of the line having a first radial dimension and second regions of the line having a second radial dimension. The second radial dimension is less than the first radial dimension. The first regions of the line are disposed between respective blade tip regions of tips of a pair of adjacent blades. In addition, the second regions of the line are radially aligned with the respective blade tip regions.

In some aspects, a fan includes a hub configured to be driven by motor to rotate about a fan rotational axis, and a band that surrounds the rotational axis and is concentric with the hub. The band includes a leading end that faces a direction of airflow through the fan, and a trailing end that is opposed to the leading edge. The fan includes blades that protrude radially from the hub, each blade including a root that is connected to the hub and a tip that is connected to a hub-facing surface of the band. A distance between the fan rotational axis and the band is constant for every location along a line that extends about the circumferences of the band, where the line is disposed on the hub-facing surface of the band at the band trailing end. A radial dimension of the band is non-uniform along the line such that the radial dimension varies periodically along the circumference of the band, and the radial dimension has a maximum value at locations between adjacent blades and a minimum value at locations aligned with a blade.

DETAILED DESCRIPTION

Figure 1:
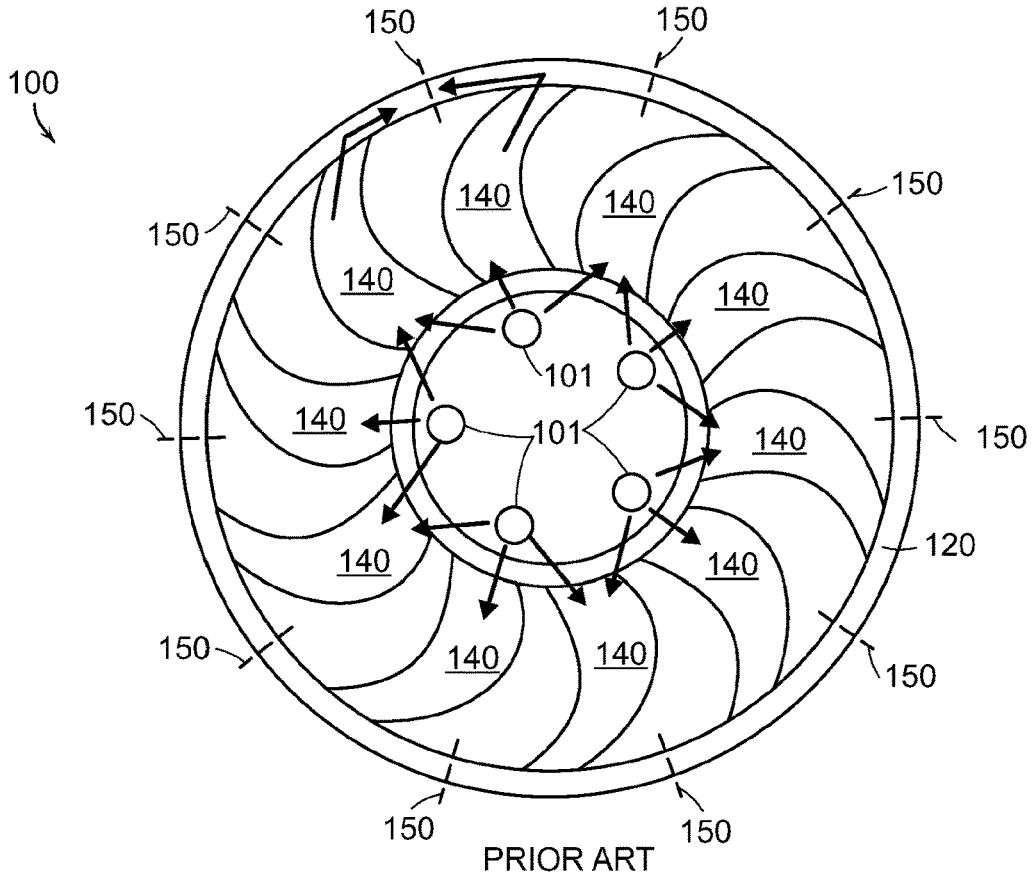
FIG. 1 is a schematic top plan view of a banded cooling fan marked with a) circles identifying locations of injection of molten plastic during an injection molding process of the fan; b) arrows showing a direction of flow of the molten plastic through a mold cavity during the injection molding process; and c) broken lines indicating the location of a knit-line between pairs of adjacent fan blades.
Figure 2:
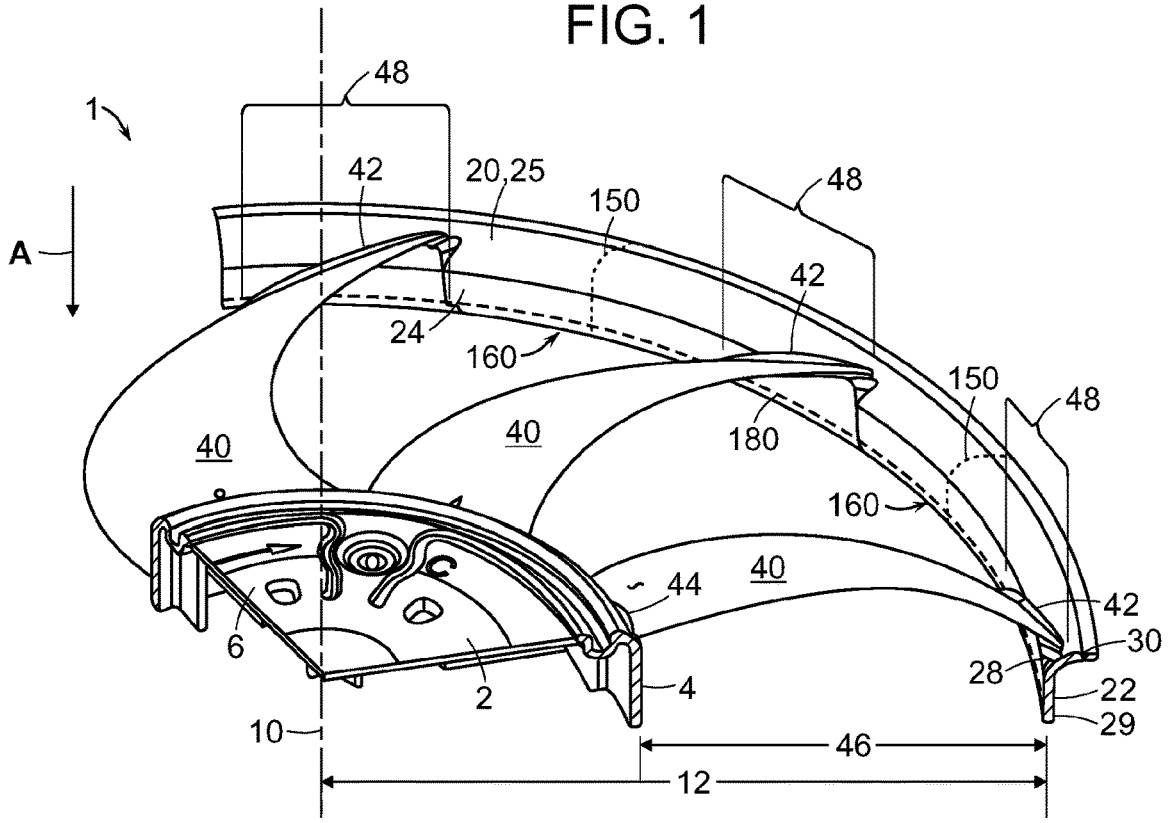
FIG. 2 is a perspective view of a portion of a banded cooling fan that includes reinforcing thickened regions, in which broken lines indicate locations of knit-lines between pairs of adjacent fan blades.
Figure 3:
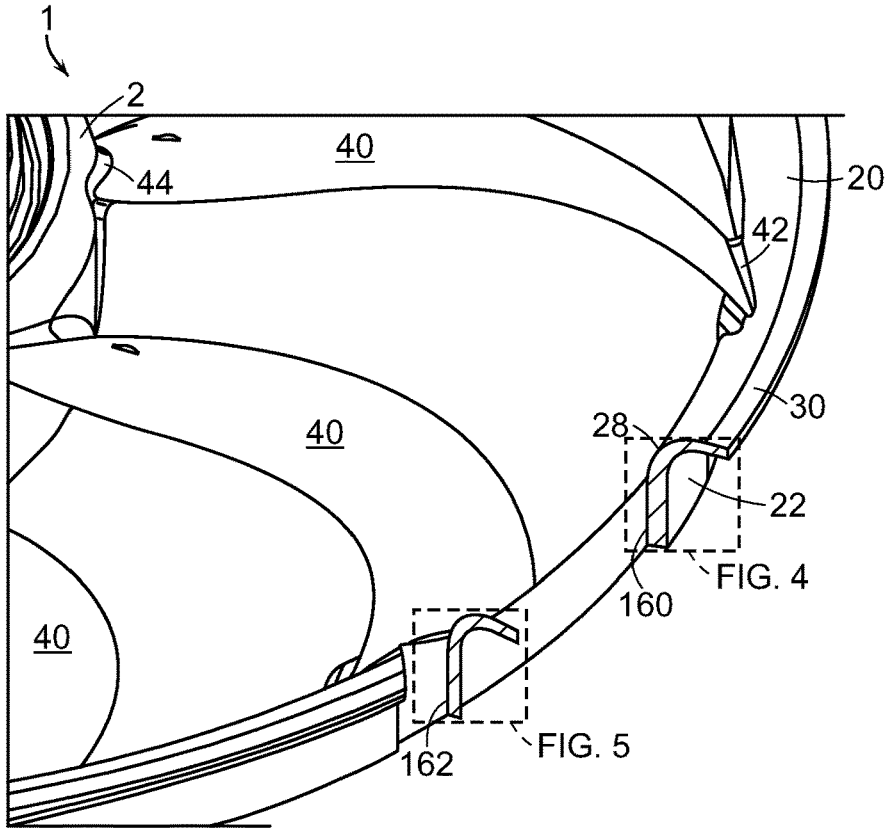
FIG. 3 is a perspective view of a portion of the banded cooling fan of FIG. 2 illustrating the band with cut-away portions showing cross sections of the band at the knit-line and a cross section of the band at the blade tip region.
Figure 4:
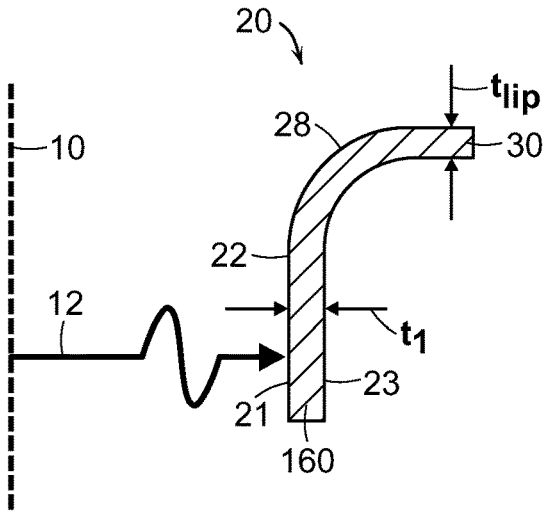
FIG. 4 is a cross-sectional view of the band at the location referenced in FIG. 3 as "FIG. 4."
Figure 5:
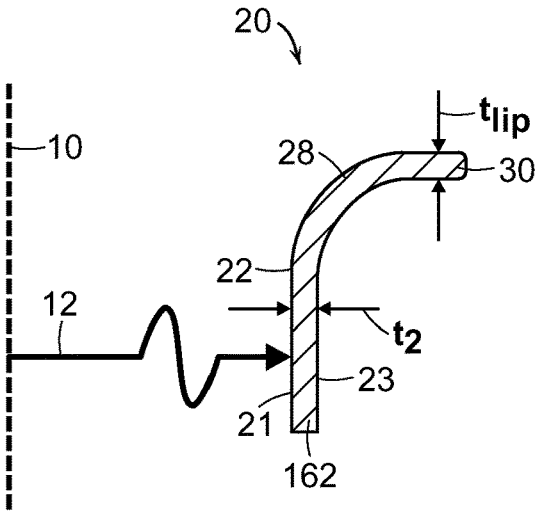
FIG. 5 is a cross-sectional view of the band at the location referenced in FIG. 3 as "FIG. 5."
Figure 6:
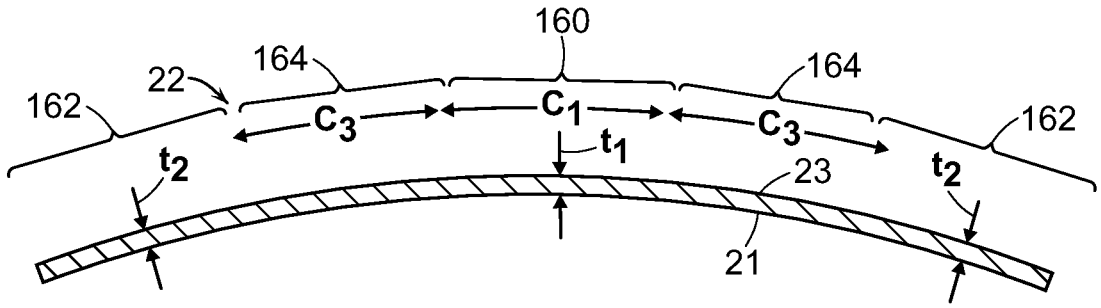
FIG. 6 is a cross-sectional view of the band as seen along line A-A of FIG. 7.
Figure 7:
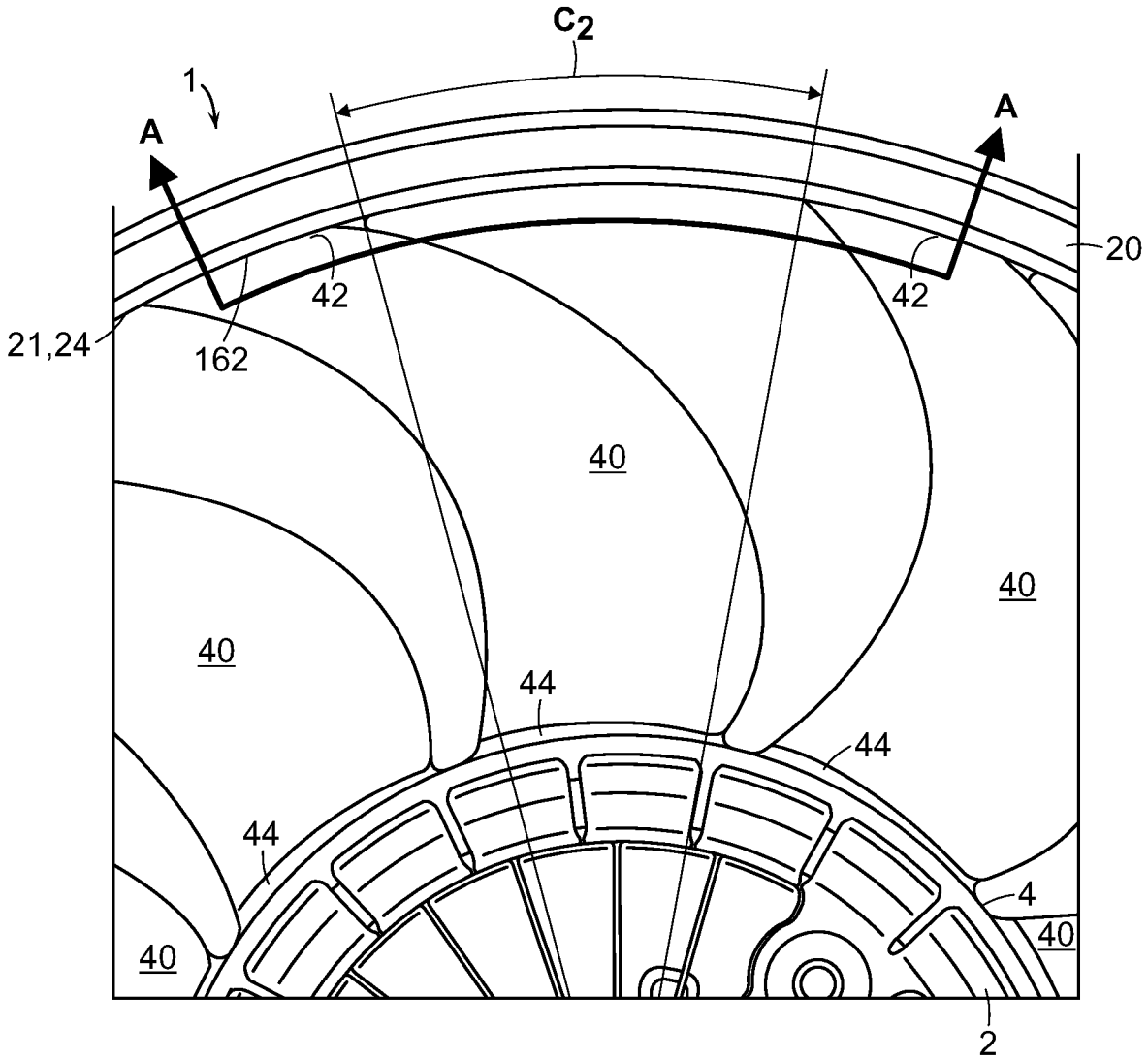
FIG. 7 is a bottom plan view of a portion of the fan.

Referring to FIGS. 2-8, an axial flow fan 1, which may be used for cooling heat exchange medium passing an inside of a heat exchanger such as a radiator of an automobile, is provided with a hub 2 that is coupled to a driving source (not shown) such as a motor. The fan 1 includes a plurality of blades 40 that protrude radially outward from the hub 2. In addition, the fan 1 includes a band 20 that surrounds the hub and connects the tips 42 of each blade 40 so as to prevent the blades 40 from being deformed. The hub 2, the blades 40 and the band 20 are formed as a single piece, for example in an injection molding process. The fan 1 is rotated by rotational force transferred from the motor to the hub 2. In the illustrated embodiment, the fan 1 rotates about the fan rotational axis 10 in the clockwise direction with respect to the view shown in FIG. 2, and the air flow direction, represented by the arrow A, is parallel to the fan rotational axis 10. The band 20 includes thickened regions 160 that reduce band stress and increase the structural integrity of the band 20 in the vicinity of the knit-lines 150. The thickened regions 160 are described in detail below.

The hub 2 is a hollow cylinder that is closed at one end by an end surface 6 that is perpendicular to the fan rotational axis 10. An outer circumference 4 of the hub 2 faces the band 20.

Each blade 40 includes a root 44 that is coupled to the band-facing surface 4 of the hub 2, and a tip 42 that is spaced apart from the root 44. Each tip 42 is coupled to a hub-facing surface 24 of the band 20. The air-flow directing surfaces of each blade 40 have a complex, three-dimensional curvature that is determined by the requirements of the specific application. The blade configuration, including the number of blades 40 employed by the fan 1, the shape of the blades 40, the blade spacing, etc., are also determined by the requirements of the specific application.

The direction of the air flow that is discharged from the fan 1 is dependent at least in part on the blade curvature, and includes a substantial axial flow component. As used herein, the term "axial flow component" refers to a component of air flow that flows in a direction parallel to the fan rotational axis 10.

The band 20 is generally an L-shaped circumferential ring that is concentric with hub 2 and is spaced radially outward from hub 2. In particular, the band 20 includes a cylindrical portion 22 that corresponds to one leg of the L-shape and extends in parallel to the fan rotational axis 10. The band 20 includes a lip portion 30 that corresponds to the other leg of the L-shape and extends at an angle to the fan rotational axis 10. In the illustrated embodiment, the lip portion 30 is perpendicular to the cylindrical portion 22, and provides the leading end 25 of the band 20 with respect to the direction A of air flow through the fan 1. In addition the band 20 includes a curved intermediate portion 28 that connects one end of the cylindrical portion 22 to one end of the lip portion 30. The cylindrical portion 22 encircles the hub 2, and the lip portion 30 protrudes from the cylindrical portion 22 in a direction away from the hub 2.

The band 20 has a first surface 21 that faces, and comes into contact with, air flowing through the fan 1, and a second surface 23 that is opposed to the first surface. Accordingly, the hub-facing surface 24 of the cylindrical portion 22 provides a portion of the first surface 21.

Each blade tip 42 is joined to the hub-facing surface 24 of the cylindrical portion 22 along a circumferentially-extending region referred to as the "blade-tip region" 48 of the cylindrical portion 22.

The cylindrical portion 22 of the band 20 includes structurally-reinforcing thickened regions 160 that protrude from the second surface 23. As used herein, references to the thickness of the band 20 correspond to a distance between the first surface 21 and the second surface 23. Within the cylindrical portion 22, the thickness of the band 20 corresponds to the radial dimension of the band 20, whereas within the lip portion 30, the thickness of the band 20 corresponds to the axial dimension of the band 20.

Since the fan 1 is injection molded, the fan 1 includes structures that facilitate the injection molding manufacturing process. For example, the hub 2 and band 20 may have a draft angle that allows the fan 1 to be removed from a mold. In another example, the surfaces of the hub 2 and band 20 that face each other may include shut offs that control flow of molten plastic within the mold in the vicinity of the parting line. Although the band 20 includes features such as draft and shutoffs that are required for manufacturing purposes and that affect the thickness of the band 20, such manufacturing-related features do not reinforce the knit-lines 150 and are not considered to be part of the thickened regions 160. Since the manufacturing-related features such as draft and shut-offs do not extend to a trailing end 29 of the band (e.g., the end of the band 20 that is most downstream with respect to the direction A of air flow through the fan 1), the thickened region 160 may be defined with respect to a line 180 that extends about a circumference of the band, where the line 180 is disposed on the hub-facing surface 24 of the band 20 at the trailing end 29. In particular, the distance 12 between the fan rotational axis 10 and the hub-facing surface 24 of the band 20 is constant for every location along the line 180, and the radial dimension of the band 20 is non-uniform along the line 180. That is, the thickened region 160 corresponds to a protrusion from the band second surface 23. It is understood that the thickened region 160 is not limited to the line 180 and extends axially between the lip 30 and the trailing end 29.

Each thickened region 160 has a thickness t1 that is greater than the thickness t2 of the band cylindrical portion 22 at locations spaced apart from (e.g., between) the thickened regions 160. In particular, the portions of the band cylindrical portion 22 that are radially aligned with the blade tip regions 48 are not provided with an increased thickness, and are referred to as non-thickened regions 162. In the non-thickened regions 162, the band cylindrical portion 22, the band intermediate portion 28 and the band lip portion 30 each have the thickness t2. In the illustrated embodiment, the thickness t2 of non-thickened regions 162 is equal to the thickness $t_{lip}$ of the lip portion 30. Although the thickened regions 160 may extend axially (e.g., in a direction parallel to the fan rotational axis 10) into a portion of the curved intermediate portion 28, the lip portion 30 of the band 20 is free of thickening and has a uniform thickness $t_{lip}$ about the circumference of the band 20.

In some embodiments, the thickness t1 of the thickened regions 160 is at least five percent greater than the thickness t2 of the non-thickened regions 162. In other embodiments, the thickness t1 of the thickened regions 160 is at least 10 percent, 20 percent, 30 percent, 40 percent, 50 percent or 60 percent greater than the thickness t2 of the non-thickened regions 162. The thickness t1 of the thickened regions 160 is determined based on the requirements of the specific application, while improving knit line strength and minimizing band mass increases, and thus also minimizing corresponding increases in the centrifugal stresses.

The band 20 includes a thickened region 160 disposed between each pair of adjacent blades 40 such that a single thickened region 160 is disposed between each pair of adjacent blades 40. In the illustrated embodiment, the number of thickened regions 160 equals the number of blades 40.

The thickened regions 160 are disposed between respective tips 42 of an adjacent pair of the blades 40. In the illustrated embodiment the thickened region 160 is disposed mid-way between the respective tips 42 of the adjacent pair of blades 40 so as to extend across the corresponding knit-line 150. However, in applications in which the knit-line 150 is not disposed mid-way between the respective tips 42, such as might occur in fans having unequal blade spacing, it is understood that the thickened region 160 may be offset toward one blade of the adjacent pair of blades in order to bridge the knit-line 150.

Each thickened region 160 extends circumferentially. In some embodiments, a circumferential dimension c1 of each thickened region 160 is in a range of 5 percent to 50 percent of the inter-blade arc length c2, where the inter-blade arc length corresponds to a distance along the hub-facing surface 24 between the respective tips 42, or blade tip regions 48, of adjacent blades 40.

The cylindrical portion 22 of the band 20 includes transition regions 164 that are disposed between each thickened region 160 and the adjacent blade tips 42. In some embodiments, the sum of the circumferential dimension c1 of each thickened region 160 and the circumferential dimensions c3 of the adjoining transition regions 164 is in a range of 50 percent to 100 percent of the inter-blade arc length c2.

In the embodiment illustrated in FIGS. 2-8, the circumferential dimension c3 of each of the transition regions 164 adjoining the thickened region 160 is about the same as the circumferential dimension c1 of the thickened region 160, each region 164, 160, 164 extending along approximately one-third of the inter-blade arc length c2. In other embodiments, the thickened region 160 may not extend circumferentially since the maximum thickness may occur at a single, substantially zero-width line (e.g., in this case, the circumferential dimension c1 of each thickened region 160 approaches zero), and the transition regions 164 may be relatively large so that the thickness change is very gradual across the inter-blade space.

Thus, the band cylindrical portion 22 has a non-uniform thickness along the circumference of the band 20 such that the thickness varies periodically along the circumference of the band. In addition, the cylindrical portion 22 has a maximum thickness at locations between adjacent blades 40, and a minimum thickness at locations aligned with a blade 40.

The thickened regions 160 have a low profile, in that the thickness t1 of the thickened region 160 is at most 20 percent of a blade span 46, where the blade span 46 corresponding to the distance between the root 44 and the tip 42 of one of the blades 40. This configuration minimizes fan diameter, improving packaging flexibility. In some applications such as engine cooling, an engine cooling fan may have a thickened region 160 in which the thickness t1 may be in a range of two to three percent of the blade span 46. Since the thickened regions 160 have a relatively large circumferential extent, it is assured that each band knit-line 150 will lie in the radial projection of a thickened region 160. In turn, this ensures that the thickened regions 160 properly reinforce the respective knit-lines 150 even when there are relatively large variations in the location of plastic injection during the manufacturing process.

By providing the thickened region 160 on the second surface 23 of the band 20, flow losses as air passes through the fan 1 are minimized.

Figure 8:
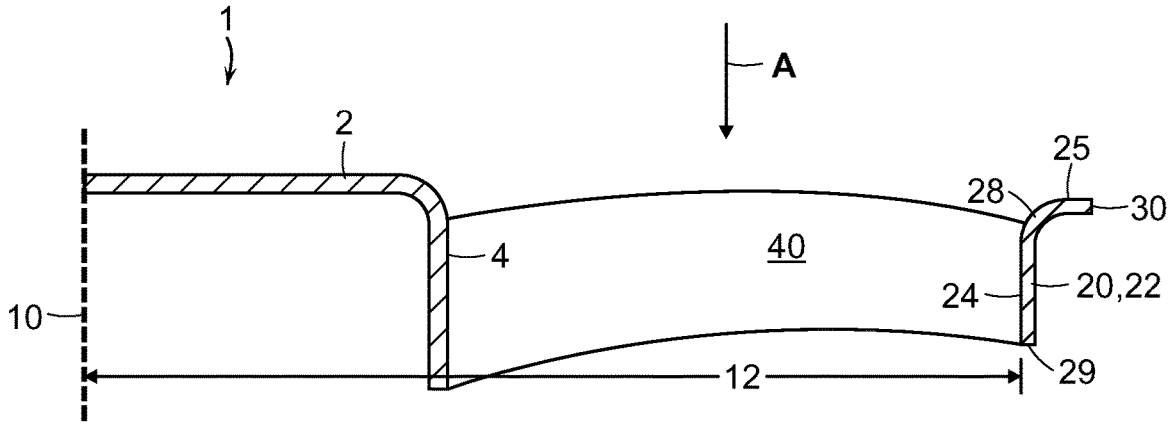
FIG. 8 is a side cross-sectional view of a portion of the fan of FIG. 2.
Figure 9:
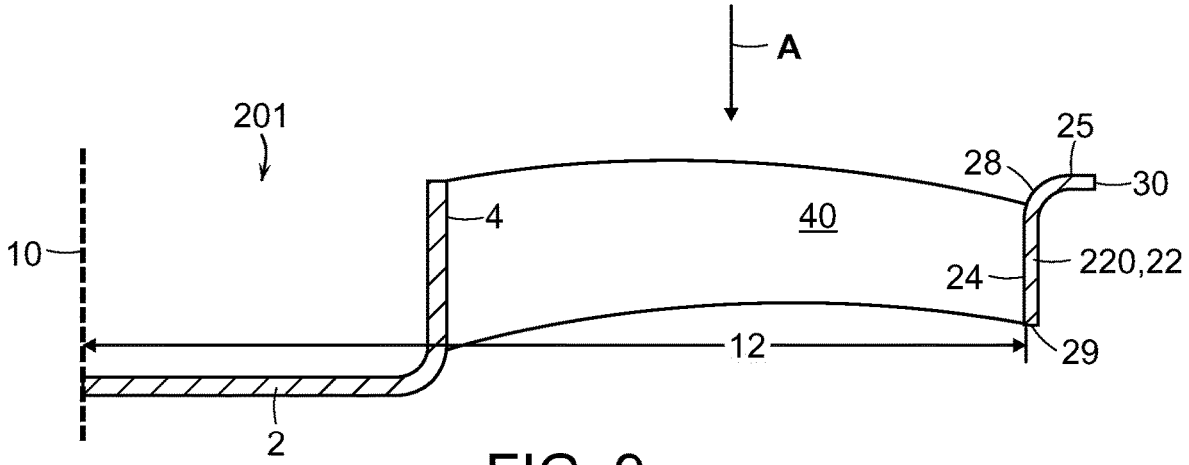
FIG. 9 is a side cross-sectional view of a portion of an alternative embodiment fan.
Figure 10:
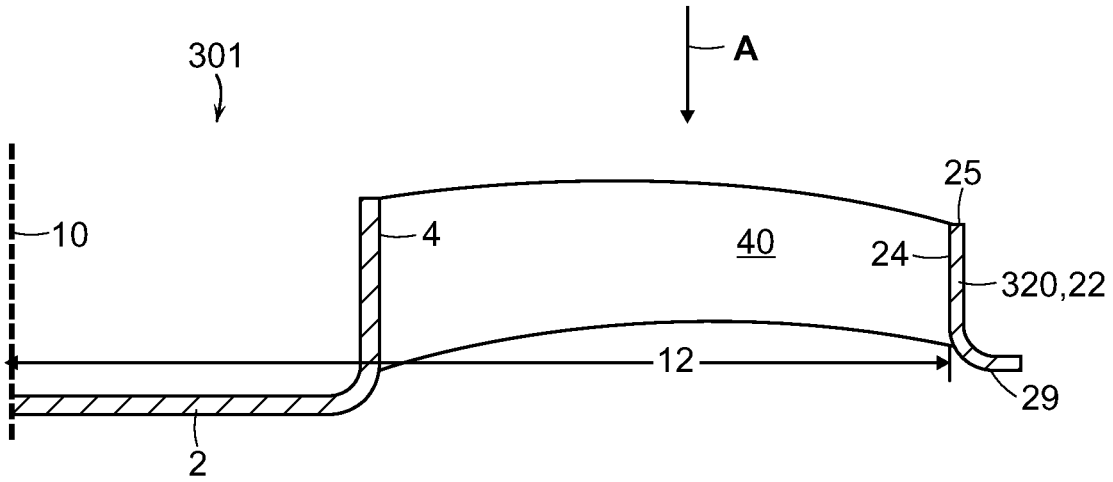
FIG. 10 is a side cross-sectional view of a portion of another alternative embodiment fan.
Figure 11:
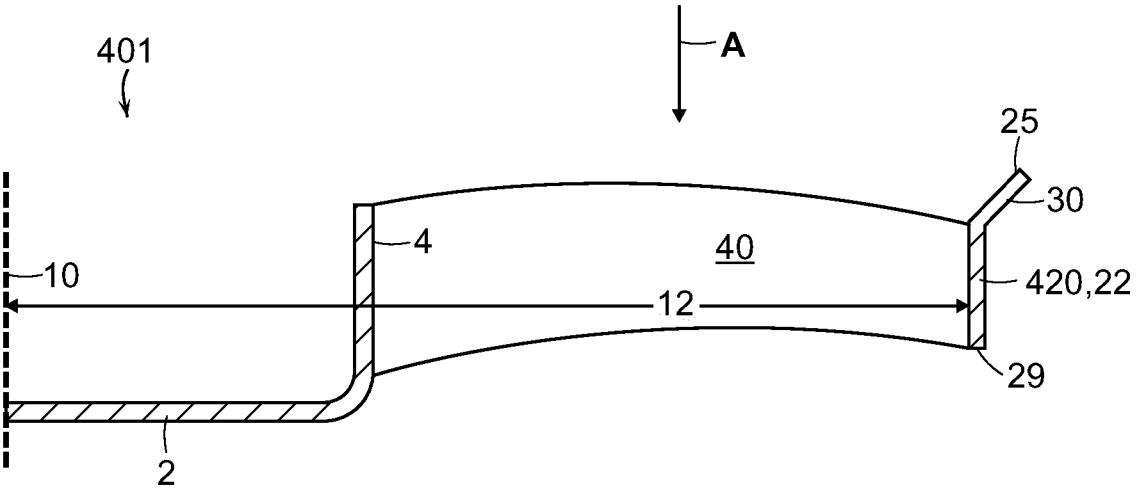
FIG. 11 is a side cross-sectional view of a portion of yet another alternative embodiment fan.

Employment of thickened regions 160 on the band 20 is not limited to the fan 1 having a downstream-stator design, as shown in FIGS. 2-8, where the stator (not shown) supports a motor (not shown) which drives the fan 1 via the hub 2. In the downstream-stator design, the stator is disposed downstream of the fan 1 with respect to the direction A of air flow through the fan 1. In the downstream-stator design, the lip portion 30 provides a leading end 25 of the band 20. The thickened regions 160 can be employed to reinforce the band knit lines 150 in a fan 201 having an upstream-stator design, as shown in FIG. 9. In an upstream-design, the stator is disposed upstream of the fan 201 with respect to the direction A of air flow through the fan 201. In FIG. 9, the lip portion 30 provides the leading end 25 of the band 220. In an alternative fan 301 having an upstream-stator design (FIG. 10), the lip portion 30 provides the trailing end 29 of the band 320. Although the lip portion 30, as shown in FIGS. 8-10, may extend in a direction perpendicular to the fan rotational axis 10, the lip portion 10 is not limited to this configuration. For example, in some embodiments, the lip portion 30 may extend at an acute angle relative to the fan rotational axis 10, as shown in the alternative band 420 of the upstream-stator design fan 401 illustrated in FIG. 11, or in downstream-stator design fans (not shown).

Although the cooling fans illustrated in FIGS. 2-11 are automotive cooling fans, the cooling fans described in FIGS. 2-11 are not limited to automotive applications. For example, the cooling fans may be used in a computer to cool a hard drive, in a heating and ventilation unit to cool a compressor, etc. Moreover, the cooling fan illustrated in FIGS. 2-11 is not limited to being used in cooling applications.

Selective illustrative embodiments of the fan are described above in some detail. It should be understood that only structures considered necessary for clarifying the fan have been described herein. Other conventional structures, and those of ancillary and auxiliary components of the fan, are assumed to be known and understood by those skilled in the art. Moreover, while a working example of the fan has been described above, the fan is not limited to the working example described above, but various design alterations may be carried out without departing from the fan as set forth in the claims.

I claim:

1. A fan, the fan comprising:

a hub configured to be driven by motor to rotate about a fan rotational axis;

a band that surrounds the rotational axis and is concentric with the hub, the band including a leading end that faces a direction of airflow through the fan, and a trailing end that is opposed to the leading edge; and blades that protrude radially from the hub, each blade comprising a root that is connected to the hub and a tip that is connected to a hub-facing surface of the band, wherein a distance between the fan rotational axis and the band is constant for every location along a line that extends about the circumferences of the band, where the line is disposed on the hub-facing surface of the band at the band trailing end, and a radial dimension of the band is non-uniform along the line.

2. The fan of claim 1, wherein the band comprises:

a cylindrical portion that extends in parallel to the fan rotational axis, the cylindrical portion including the band trailing end;

a lip portion that extends at an angle relative to the fan rotational axis, a surface of the lip portion including the band leading end; and an intermediate portion that connects one end of the cylindrical portion to one end of the lip portion, and wherein the tip of each blade is joined to the cylindrical portion along a corresponding blade tip region, the cylindrical portion includes first regions of the line having a first radial dimension and second regions of the line having a second radial dimension, the second radial dimension is less than the first radial dimension, the first regions of the line are disposed between respective blade tip regions of tips of a pair of adjacent blades, and the second regions of the line are radially aligned with the respective blade tip regions.

3. The fan of claim 2, wherein the first radial dimension is greater than an axial dimension of the lip portion.

4. The fan of claim 2, wherein the first radial dimension is at least five percent greater than the second radial dimension.

5. The fan of claim 2, wherein a dimension of the intermediate portion is non-uniform along a circumference of the band such that the dimension of the intermediate portion at locations radially aligned with the first regions of the line is greater than corresponding dimensions of the intermediate portion at locations radially aligned with the second regions of the line.

6. The fan of claim 2, wherein the cylindrical portion includes third regions of the line having a tapered radial dimension, the third regions of the line providing a transition between the first regions of the line and the second regions of the line, wherein a circumferential dimension of each third region of the line is at least as long as a circumferential dimension of the first region of the line that it adjoins.

7. The fan of claim 2, wherein the cylindrical portion includes third regions of the line having a tapered radial dimension, the third regions of the line providing a transition between the first regions of the line and the second regions of the line, wherein a sum of the circumferential dimensions of one of the first regions of the line and each adjoining third region of the line is at least fifty percent of a distance between tips of adjacent blades.

8. The fan of claim 1, wherein the radial dimension of the band is non-uniform along the line such that the radial dimension varies periodically along the circumference of the band, and the radial dimension is a maximum at locations between adjacent blades and is a minimum at locations aligned with a blade.

9. The fan of claim 1, wherein the band comprises:

a cylindrical portion that extends in parallel to the fan rotational axis, the cylindrical portion including the band leading end;

a lip portion that extends at an angle relative to the fan rotational axis, a surface of the lip portion including the band trailing end; and an intermediate portion that connects one end of the cylindrical portion to one end of the lip portion, and wherein the tip of each blade is joined to the cylindrical portion along a corresponding blade tip region, the cylindrical portion includes first regions of the line having a first radial dimension and second regions of the line having a second radial dimension, the second radial dimension is less than the first radial dimension, the first regions of the line are disposed between respective blade tip regions of tips of a pair of adjacent blades, and the second regions of the line are radially aligned with the respective blade tip regions.

10. A fan, the fan comprising:

a hub configured to be driven by motor to rotate about a fan rotational axis;

a band that surrounds the rotational axis and is concentric with the hub, the band including a leading end that faces a direction of airflow through the fan, and a trailing end that is opposed to the leading edge; and blades that protrude radially from the hub, each blade comprising a root that is connected to the hub and a tip that is connected to a hub-facing surface of the band, wherein a distance between the fan rotational axis and the band is constant for every location along a line that extends about the circumferences of the band, where the line is disposed on the hub-facing surface of the band at the band trailing end, a radial dimension of the band is non-uniform along the line such that the radial dimension varies periodically along the circumference of the band, and the radial dimension has a maximum value at locations between adjacent blades and a minimum value at locations aligned with a blade.

* * * * *